US005137473A

United States Patent [19]

Nickola

[11] Patent Number: 5,137,473

[45] Date of Patent: Aug. 11, 1992

[54] FUSED PROTECTION DEVICE

[76] Inventor: Anne D. Nickola, G-6261 N. Saginaw Rd., Mt. Morris, Mich. 48458

[21] Appl. No.: 723,046

[22] Filed: Jun. 28, 1991

[51] Int. Cl.[5] ..... H01R 13/68

[52] U.S. Cl. ..... 439/622; 439/373

[58] Field of Search ..... 439/622, 369, 371, 373

[56] References Cited

U.S. PATENT DOCUMENTS 2,676,223 4/1954 Whitaker ..... 439/622 X
4,025,146 5/1977 Famiglietti et al. ..... 439/622
4,275,374 6/1981 Chaucer ..... 439/622 X
4,484,185 11/1984 Graves ..... 439/373 X
4,575,704 3/1986 Pezold ..... 439/622 X

*Primary Examiner*—Eugene F. Desmond
*Attorney, Agent, or Firm*—Gifford, Groh, Sprinkle, Patmore & Anderson

[57] ABSTRACT

A fused protection device to be installed between a conventional male and a conventional female electrical plug and adapted to receive a fuse to thereby isolate and protect an appliance or the like from overloading a circuit.

3 Claims, 2 Drawing Sheets 10
12
14
16
18
20
22
24
26
28
30

FUSED PROTECTION DEVICE

BACKGROUND OF THE INVENTION

1. Field of the Invention

The present invention relates generally to a fused protection device. More particularly, the present invention relates to a fused protection device that is easily attachable to and removable from a variety of electrical appliances that draw between ¼ and 15 amps.

2. Description of the Prior Art

Fused plugs are often used to prevent circuit overload in electrical appliances.

In a standard fused plug, an appliance must be wired to the plug by the consumer. One disadvantage of a standard plug is that it is not convenient since the plug is not readily attached and removed from the appliance but rather must be wired by the consumer.

In U.S. Pat. No. 4,419,567 for "MODULAR HEATING CABLE ASSEMBLY" a fused circuit overload device that incorporated within heat tape modules is disclosed. One disadvantage of the system described in U.S. Pat. No. 4,419,569 is that its use is limited to heat tapes and it is not useful in protecting other appliances from circuit overload.

An object of the present invention is to provide a fused protection device that is easily attachable to and removable from an appliance eliminating the need for the consumer to do any wiring.

Another object of the present invention is to provide a fused protection device that can be used with a variety of appliances.

Another object of the present invention is to provide attachment means or a strap system to support the weight of the device.

SUMMARY OF THE PRESENT INVENTION

The present invention provides a fused protection device that overcomes the problems of circuit overload and that can easily be applied to various electrical appliances that draw between ¼ and 15 amps including, but not limited to heat tapes, irons, and other small appliances.

More particularly, the present invention is a fused protection device comprising a fused male electrical plug and female electrical plug. The fused male electrical plug and female electrical plug are connected, preferably through a three-ground wiring device.

The male electrical plug portion is adapted to receive a fuse having a current rating from ¼ amp to 15 amps depending upon the current required by the electrical device thereby allowing for variable current control without circuit overload.

An electrical device, such as a heat tape, can be connected directly to the female plug of the fused protection device. The fused protection device can then be directly plugged into a standard 20 amp electrical outlet and limit the maximum current being drawn by the electrical device.

A strap may be attached to the fused device to help support the weight of the fused protection device and the electrical cord attached to the appliance when it is plugged into a wall socket.

BRIEF DESCRIPTION OF THE DRAWINGS

A better understanding of the present invention will now be had upon reference to the following detailed description when read in conjunction with the accompanying drawing, in which like reference characters refer to like parts throughout the several views, and in which.

DETAILED DESCRIPTION OF THE PREFERRED EMBODIMENTS OF THE PRESENT INVENTION

Figures 1, 2:
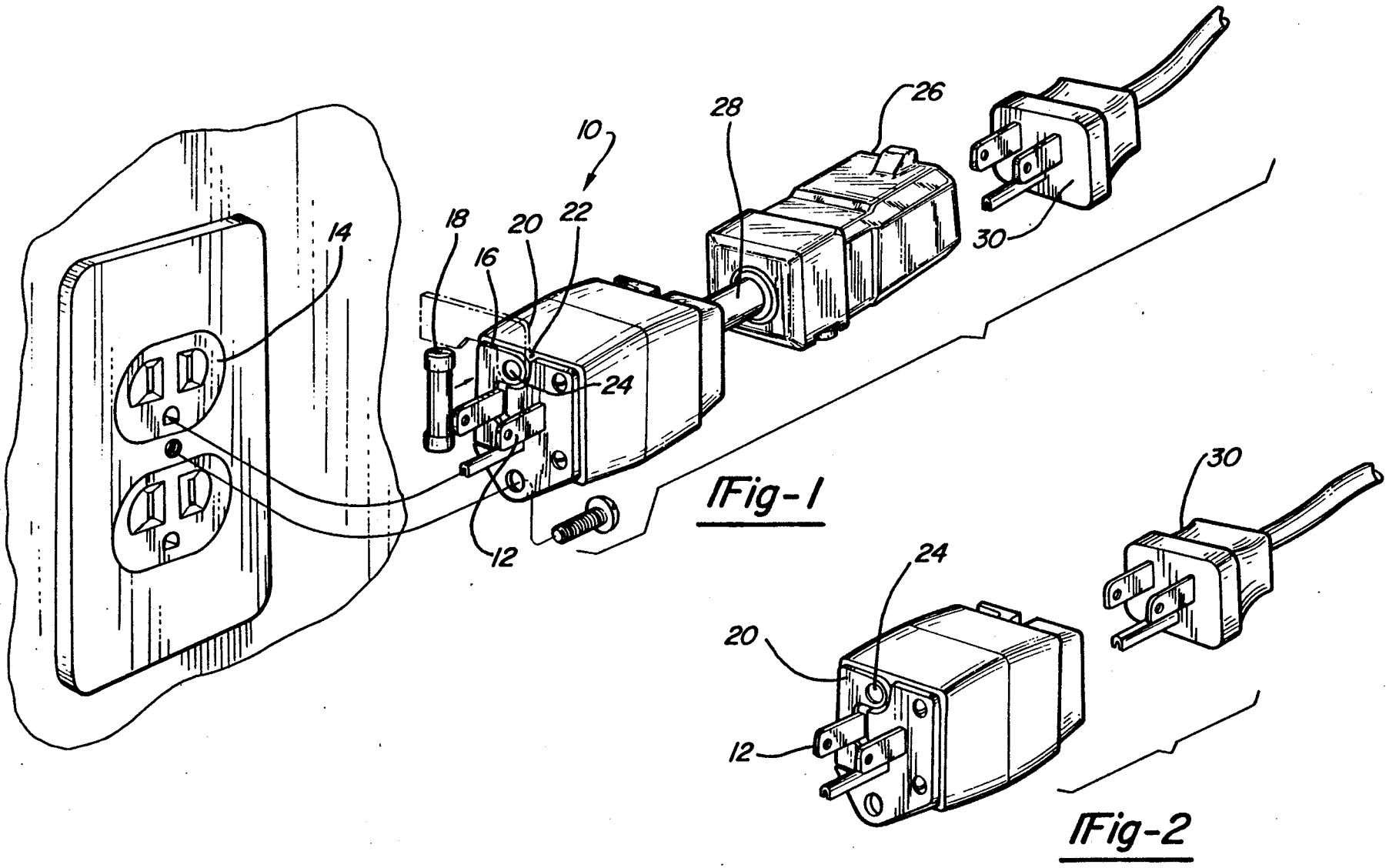
FIG. 1 is a perspective view of the embodiment of the fused protection device according to the present invention.
FIG. 2 is a perspective view of a second embodiment according to the present invention.

A fused protection device 10 is illustrated in FIG. 1. The fused protection device 10 has a male electrical plug portion 12 and a female electrical plug portion 26. The male plug portion 12 can be plugged into a standard electrical wall socket 14. The male plug portion 12 has a recess 16 in which a fuse 18 is received. The protected current value of fuse 18 may range from ¼ to 15 amps. The recess is closed by a protective cap 20. The protective cap 20 is pivotably attached to the top portion 22 of the fused protection device 10 by a pivot member 24. The protective cap 20 can be pivoted from a closed position shown by solid lines to the open position shown in phantom in FIG. 1 to gain access to the fuse 18. The fuse 18 is electrically connected in series with one of the contact prongs of the male electrical plug portion 12 in a conventional manner (not shown) so that as long as the fuse 18 retains its electrical continuity, current can flow through the male plug portion 12 to a female plug portion 26.

The female plug portion 26 is attached to the male plug portion 12 by a short three (3) wire electrical cable 28. FIG. 2 illustrates an alternate embodiment of the fused protection device which combines the male electrical plug portion 12 and the female electrical plug portion 26 into one unit.

A male electrical plug 30 of an appliance (not shown) such as a heat tape or a small appliance that draws between ¼ and 15 amps may be plugged into the female electrical plug portion 26.

The usual fuse arrangement for a household electrical system includes à fuse box in which a plurality of fuses or circuit breakers are used to protect a number of household circuits from overloading. There are usually a number of electrical outlets connected to a single circuit and each electrical outlet can individually become overloaded to a dangerous extent without overloading the entire circuit. In such situations the current capabilities of the fuse or current breaker may be too high to blow or open up and fire could result from the overload condition. This is especially dangerous when heating devices, such as heat tapes are connected to the circuit to prevent freezing of water lines and the like for mobile homes and other similar uses. Such beat tapes have a tendency to heat up and cause fires when the current limit of the fuse in the conventional fuse box is too high. By the time the requisite current has been achieved to blow the fuse it is often too late and the fire has already started. This is especially true where the homeowner has, as he or she often does, put in a fuse or circuit breaker having a current rating too high for an individual appliance. This is a common, but dangerous way, to solve the problem of the need to constantly replace fuses.

Figures 3, 4:
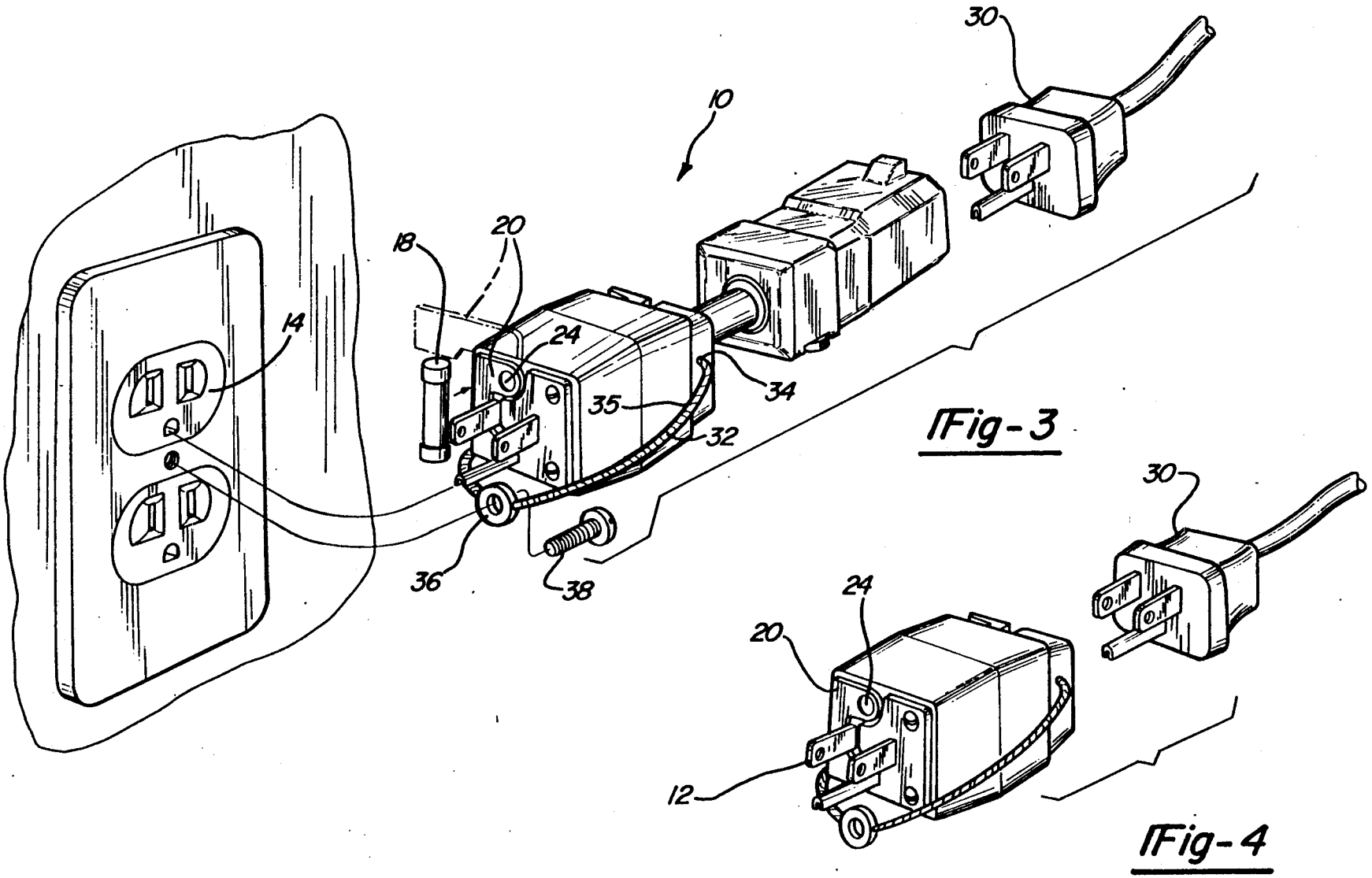
"FIG. 3 is a perspective view of a third embodiment according to the present invention.
FIG. 4 is a perspective view of a fourth embodiment according to the present invention."

In the preferred embodiments as shown in FIGS. 3 and 4, the fused protection device is attached to the electrical outlet 14 by a lock strap 32 that is connected to the fused protection device 10. After the fused protection device is plugged into an electrical outlet 14 the lock strap 32 locks the fused protection device 10 in the electrical socket so that the weight of the electrical cord of the appliance cannot pull it out of the electrical outlet.

As shown more specifically in FIG. 3 and FIG. 4, the look strap 32 consist: of a strap having its opposite ends 34 connected to the male plug portion 12. The ends 34 are attached in such a way that a loop 35 is formed at the top or bottom side of the male plug portion 12. A washer 36 is attached at central portion 36 of the lock strap 34. A screw 38 is then inserted through the washer 36 and screwed into the plate attachment threaded hole in the wall socket 14.

The present invention provides, in effect, a protective circuit between the main fuse box and the appliance or heat tape to prevent a fire in the case of an electrical failure of the appliance or heat tape. A fuse having a proper amperage rating can be inserted in the fused protection connector 10 to ensure that current will be cut off when a predetermined amperage is exceeded.

Having described my invention, however, many modifications will become apparent to those skilled in the art to which it pertains without deviation from the spirit of the invention as defined by the scope of the appended claims.

I claim:

1. A fused protection device comprising:

a male electrical plug having a pair of male connector prongs adapted to plug into a standard electrical outlet;

a female plug electrically connected to said male electrical plug;

a fuse removably disposed in said male electrical plug connected in series between a selected one of said pair of male connector prongs and said female plug;

locking means attached to said male electrical plug for securing said fused protection device to said standard electrical outlet, said locking means comprising a strap having two end portions, each of said two end portions being connected to said male electrical plug; and means for securing said strap directly to said electrical outlet.

2. The fused protection device according to claim 1, wherein the male plug and the female plug are one unit.

3. The fused protection device according to claim 1, wherein the male plug and the female plug are separate units joined by an electrical cable.

* * * * *

UNITED STATES PATENT AND TRADEMARK OFFICE

CERTIFICATE OF CORRECTION

PATENT NO. : 5,137,473

DATED : August 11, 1992

INVENTOR(S) : Anne D. Nickola

It is certified that error appears in the above-identified patent and that said Letters Patent is hereby corrected as shown below:

Column 1, line 21, after "that" insert -- is --.

Column 2, line 60, after "such" delete "beat" and insert -- heat --.

Column 3, line 13, after "consist" delete ":".

Signed and Sealed this

Twelfth Day of July, 1994

Bruce Lehman

*Attest:*

BRUCE LEHMAN

*Attesting Officer*

*Commissioner of Patents and Trademarks*